United States Patent [19]

Wu

[11] Patent Number: 5,031,485

[45] Date of Patent: Jul. 16, 1991

[54] CONTAINER LID OPENER

[76] Inventor: Miin Y. Wu, 8-2-1 Su Chuan No. 3 Street, Shi Tun, Taichung, Taiwan

[21] Appl. No.: 576,999

[22] Filed: Sep. 4, 1990

[51] Int. Cl.[5] ..... B67B 7/14

[52] U.S. Cl. ..... 81/3.44

[58] Field of Search ..... 81/3.44, 3.07, 3.4

[56] References Cited

U.S. PATENT DOCUMENTS 713,403 11/1902 Cooper ..... 81/3.44
894,626 7/1908 Givens ..... 81/3.44
1,962,193 6/1934 Heise ..... 81/417
2,931,258 4/1960 Ronning, Jr. ..... 81/3.44

*Primary Examiner*—Roscoe V. Parker

[57] ABSTRACT

An improved container lid opener comprises a lever arm, a support arm, a grasp arm and a grasp block. The support arm is pivotally connected with the lever arm. One end of the grasp arm is connected with one end of the lever arm. The grasp block is connected with the other end of the grasp arm. The rear portion of the lever arm and the rear portion of the support arm are connected by a spring assembly.

1 Claim, 3 Drawing Sheets

5–5

CONTAINER LID OPENER

BACKGROUND OF THE PRESENT INVENTION

The present invention relates to a container lid opener and more particularly to an improved container lid opener which can open a container lid easily.

Referring to FIG. 1, a user can use a conventional container lid opener 1 to pry a container lid and then unwinds the container lid by hand. However, a groove will be formed between the outer periphery of the container and the container lid after the container lid is opened. Thus the food in the container may be contaminated after the container lid is opened this way.

SUMMARY OF THE PRESENT INVENTION

The principal object of the present invention is to provide an improved container lid opener which can easily open a container lid without damaging the container lid.

Accordingly, an improved container lid opener comprises a lever arm, a support arm, a grasp arm and a grasp block. The support arm is pivotally connected with the lever arm by a pair of rivets. One end of the grasp arm is connected with one end of the lever arm. The grasp block is connected with the other end of the grasp arm. The rear portion of the lever arm and the rear portion of the support arm are connected by a spring assembly.

DESCRIPTION OF THE PREFERRED EMBODIMENT

Figure 2:
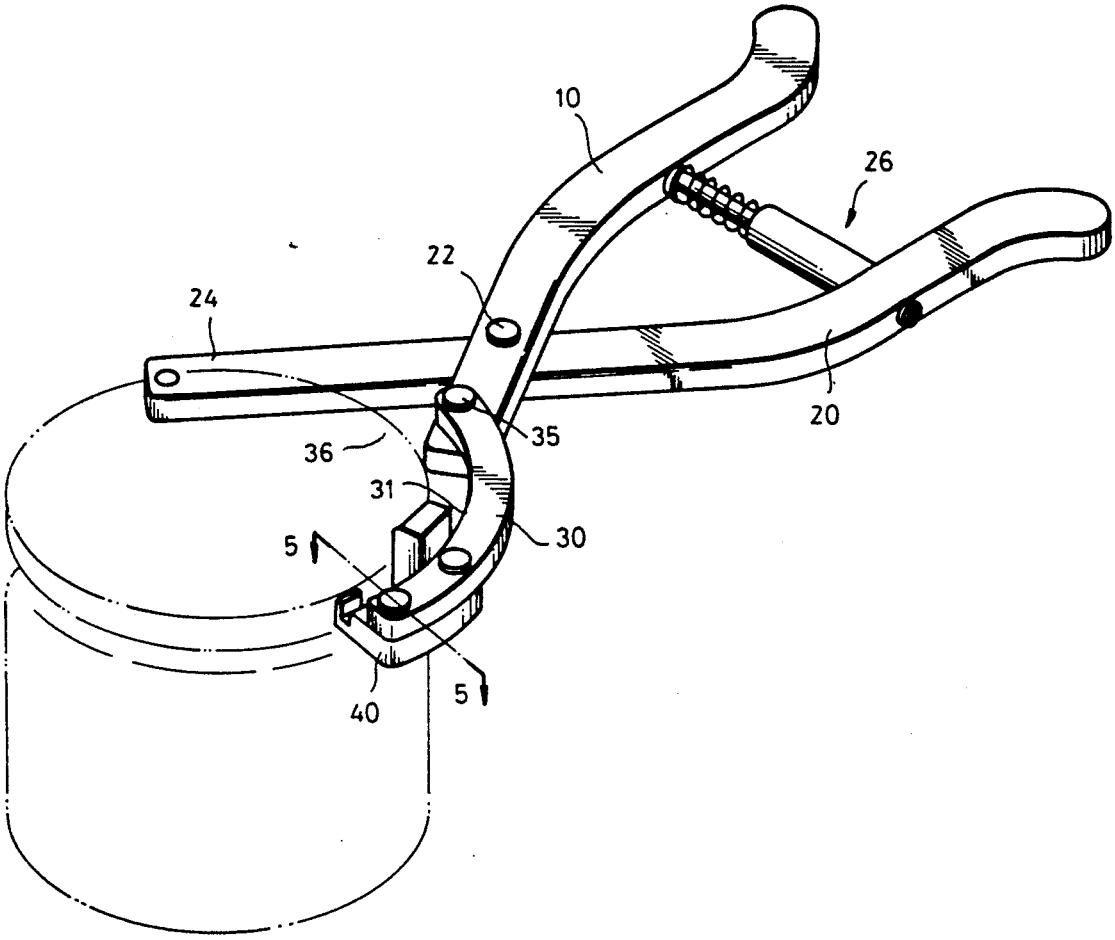
FIG. 2 is an assembly perspective view of an improved container lid opener of a preferred embodiment in accordance with the present invention.
Figure 3:
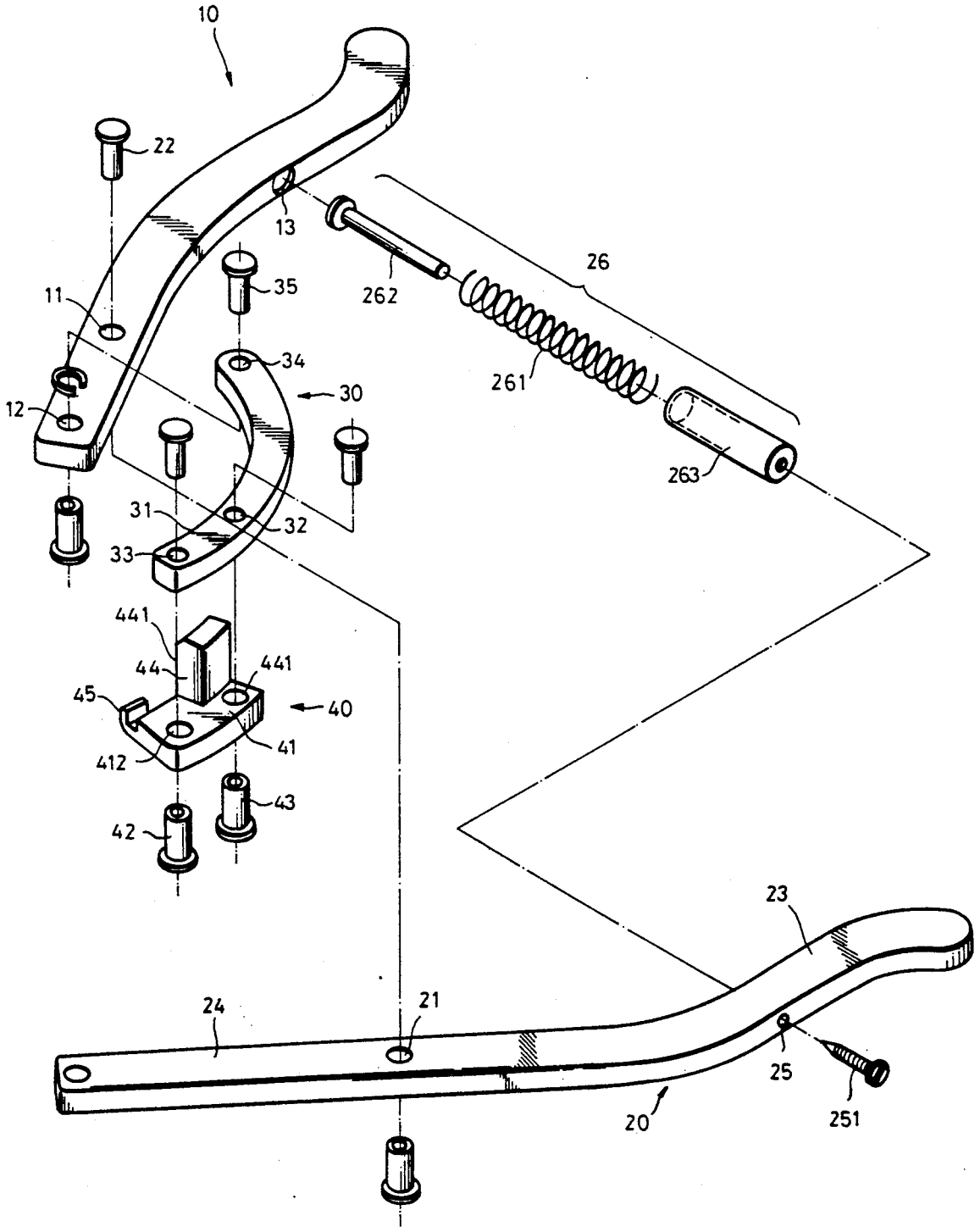
FIG. 3 is a fragmentary perspective view of an improved container lid opener of a preferred embodiment in accordance with the present invention.

Referring to FIGS. 2 and 3, an improved container lid opener comprises a lever arm 10, a support arm 20, a grasp arm 30 and a grasp block 40. A first hole 11 and a second hole 12 are formed on the front portion of the lever arm 10. A recess hole 13 is formed on one side of the rear portion of the lever arm 10. A first hole 21 is formed on the middle front portion of the support arm 20. A pair of rivets 22 pass through holes 21 and 11 and pivotally connect the lever arm 10 and the support arm 20 together. The rear portion 23 of the support arm 20 is held by one hand of a user. The front portion of the support arm 20 can hold a bottle as a support of the improved container lid opener. A through hole 25 is formed on the rear portion 23 of the support arm 20. A screw 251 passes through the through hole 25 in order to stably connect a spring assembly 26 between the lever arm 10 and the support arm 20. The spring assembly 26 has a spring 261, a bolt 262 and a pipe 23. One end of the bolt 262 is disposed in the recess hole 13, and one end of the pipe 263 is penetrated by the screw 251. The spring 261 is disposed between the bolt 262 and the pipe 263. The inner side 31 of the arc-shaped grasp arm 30 is toward a lid. A first hole 32 and a second hole 33 are formed on the front portion of the grasp arm 30. A third hole 34 is formed on the rear portion of the grasp arm 30. A pair of rivets 35 pass through holes 34 and 12. A securing base 41 has a first hole 411 and a second hole 412. A pair of rivets 42 pass through holes 412 and 33. A pair of rivets 43 pass through holes 411 and 32. A side clamp 44 is disposed on a predetermined position of the securing base 41. A lip grasp 45 is protruded from one side of the securing base 41.

OPERATION OF THE PRESENT INVENTION

Figure 1:
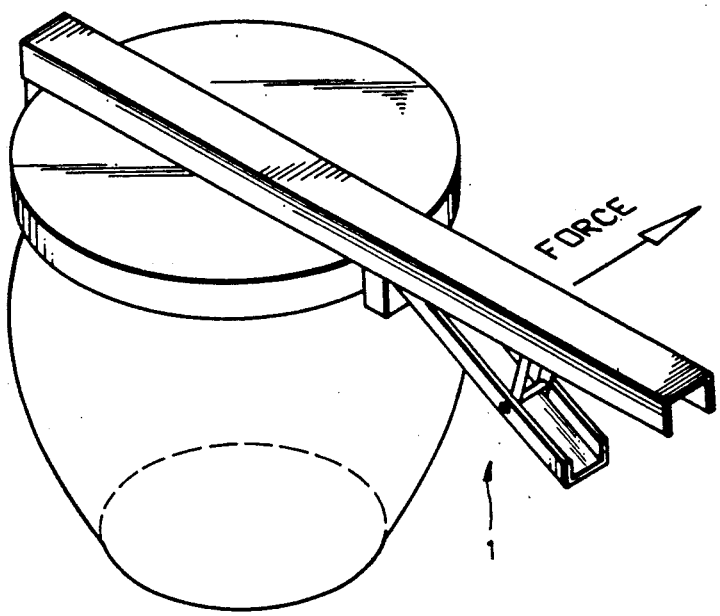
FIG. 1 is a perspective view of a conventional container lid opener of the prior art.
Figure 4:
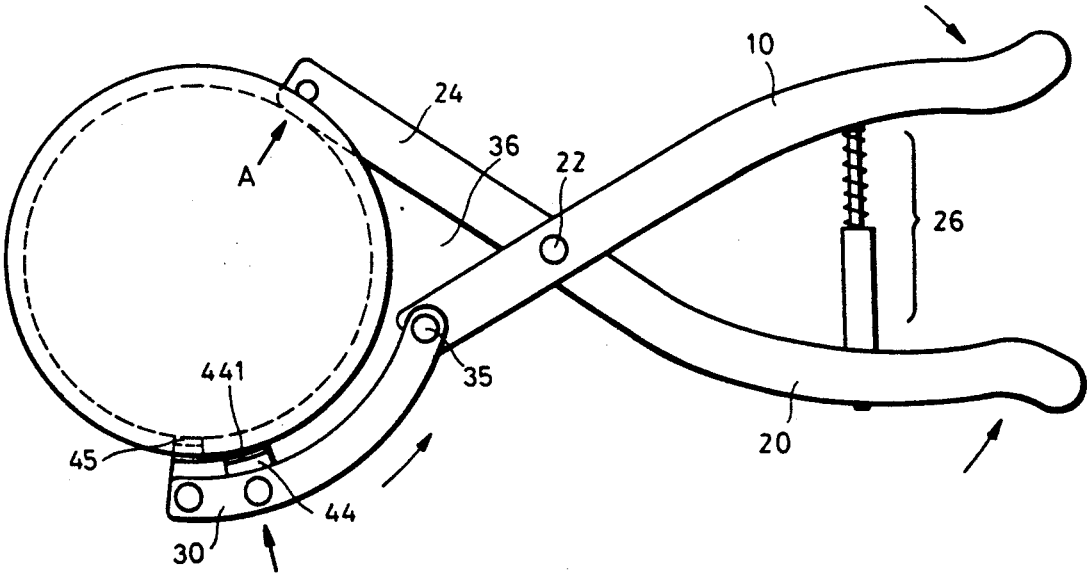
PRIOR ART FIG 4
FIG. 4 is a plan view of an improved container lid opener of a preferred embodiment in accordance with the present invention.

Referring to FIGS. 2, 3 and 4, the improved container lid opener has an opening 36 which is formed by the grasp arm 30 and the front portion 24 of the support arm 20. The securing base 41 is disposed fixedly under the front portion of the grasp arm 30. The rear end of the grasp arm 30 is connected with the front end of the lever arm 10. The lever arm 10 and the support arm 20 are pivotally connected by a pair of rivets 22.

Figure 5:
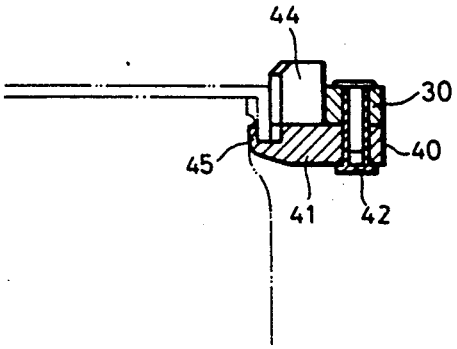
FIG. 5 is a cross-sectional view of an improved container lid opener of the present invention taken along line 5—5 of FIG. 2.

Referring to FIGS. 2, 4 and 5, a user can hold the rear portions of the lever arm 10 and the support arm 20 with one hand and hold a bottle with the other hand. At least a predetermined portion of the upper end of the bottle is enclosed by the opening 36. The front portion 24 of the support arm 20 is disposed under the lid of the bottle. The lip grasp 45 is inserted into the gap between the lid and the bottle, and the inner side 441 of the side clamp 44 is pressed toward the lid tightly. A support point A is disposed at a predetermined portion of the front portion 24 of the support arm 20. The lever arm 10 and the support arm 20 are squeezed toward each other. The lid is rotated in the counterclockwise direction by the lip grasp 45 and the side clamp 44 of block 40 so that the lid will be rotated slightly and loosened, then the user can easily unwind the lid by hand.

I claim:

1. An improved container lid opener comprising:

a lever arm;

a support arm pivotally connected with said lever arm by a pair of rivets;

a grasp arm, the rear end of said grasp arm connected with the front end of said lever arm;

a grasp block, said grasp block connected with the front end of said grasp arm;

the rear portion of said lever arm and the rear portion of said support arm being connected by a spring assembly;

said grasp block comprising a securing base and a side clamp;

wherein said side clamp is disposed on the top of said securing base, and said securing base provides a lip grasp protruded from one side of said securing base.

* * * * *